US005271434A

United States Patent [19]

Debaes

[11] Patent Number: 5,271,434

[45] Date of Patent: Dec. 21, 1993

[54] CONTROL MECHANISM FOR THE RAPIER HEADS OF WEAVING MACHINES

[75] Inventor: Johnny Debaes, Wenduine, Belgium

[73] Assignee: N.V. Michel Van de Wiele, Marke, Belgium

[21] Appl. No.: 922,502

[22] Filed: Jul. 31, 1992

[30] Foreign Application Priority Data

Sep. 16, 1991 [BE] Belgium ..... 09100859

[51] Int. Cl.[5] ..... D03D 47/20

[52] U.S. Cl. ..... 139/448

[58] Field of Search ..... 139/57, 448, 447, 446, 139/449; 74/141.5, 142, 143

[56] References Cited

U.S. PATENT DOCUMENTS 3,047,028 7/1962 Rotrekl ..... 139/57
3,927,699 12/1975 Volpe .
3,998,251 12/1976 Hadam ..... 139/448

FOREIGN PATENT DOCUMENTS 2934474 10/1980 Fed. Rep. of Germany .
1574627 7/1969 France .
3-161551 7/1991 Japan ..... 139/448

*Primary Examiner*—Andrew M. Falik
*Attorney, Agent, or Firm*—James Creighton Wray

[57] ABSTRACT

A control mechanism for operating positively controlled openings of rapier heads of weaving machines equipped with rapiers. The control mechanism has a first and a second lateral cam and first and second rollers driven by the cams respectively. The rollers are mounted on a pivoting lever. First and second control levers are directly connected to an oscillating shaft of a cam lever, the cam lever moving to and fro by means of the cam. The cam is connected to a main shaft which transmits a uniform rotation speed to the shafts.

10 Claims, 2 Drawing Sheets

CONTROL MECHANISM FOR THE RAPIER HEADS OF WEAVING MACHINES

BACKGROUND OF THE INVENTION

The invention relates to a mechanism for the opening of the rapier heads of a weaving machine which works with rapiers.

With rapier weaving machines a problem exists for releasing the weft at the right moment from the receiving rapier at the completion of the weft insertion. If the weft is released too early by the receiving rapier, then the weft springs back into the shed and then a piece of weft is missing in the fabric on that fabric side. Weft faults develop because of this and the fabric obtained is not of desired quality. If on the other hand the weft is held too long by the receiving rapier, then long weft ends develop outside the weave edges, which causes the weft loss to increase.

With rapier weaving machines this means that the machines should be able to time the release of the weft by the receiving rapier at the right moment so that the above mentioned disadvantages do not occur.

More over double rapier weaving machines are weaving various pile height this means that the rapiers should have different positions in height and that the distance between the rapiers need to be set. Hence there is a requirement to make the control of rapier heads also adjustable in position and in mutual distance, according to the rapier distance and pile height to be woven.

In order to remedy this the opening of the rapier heads is controlled by a system of rod linkages. The control of the rod heads is assured by a cam disk, sometimes also with a spring return.

This kinematic chain is however too long, and too much play develops at the end lever as a result of the various plays in the numerous pivots and bearings. Namely vibrations develop in the end lever which bring about difficulties in the opening of the receiving rapier. These vibrations cause wear and tear of the rod heads which therefore have to be replaced.

Furthermore this solution no longer satisfies the present working speed to be achieved by the weaving machines, in particular for double rapier weaving machines this is 400 r.p.m.

SUMMARY OF THE INVENTION

The control mechanism for the positively controlled opening of the rapier heads according to the invention is intended to provide a solution to the above mentioned problem and for remedying these disadvantages, and also to allow a greater speed of weaving.

The control mechanism for the positively controlled opening of the rapier heads of a weaving machine according to the invention is characterized in that the opening of the rapier heads is positively controlled by means of rollers on a control lever, directly connected to an oscillating shaft of a cam follower lever which in its turn moves forwards and backwards through the of a double cam, of which the rotation is assured from the main shaft.

Further characteristics and advantages of the control mechanism for the opening of the rapier heads according to the invention will appear from the following description of a preferred embodiment of such a control mechanism for a double rapier weaving machine, without the invention being limited to this type of weaving machine, since it can also be utilized with a single rapier weaving machine. This description is illustrated by means of the attached drawings.

DETAILED DESCRIPTION OF THE DRAWINGS

Figure 1:
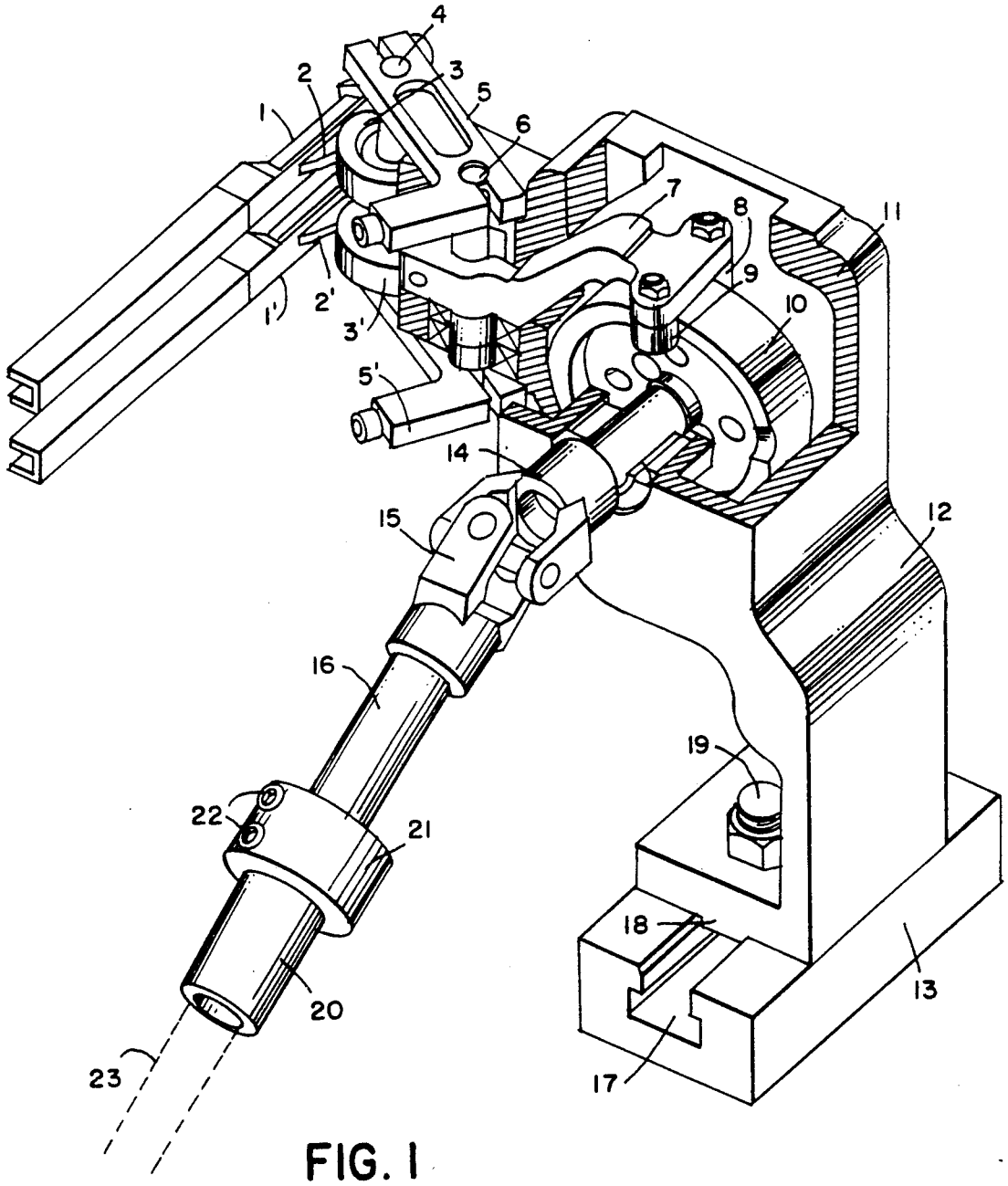
FIG. 1 is a perspective representation of a control mechanism according to the invention for a double rapier weaving machine.
Figure 2:
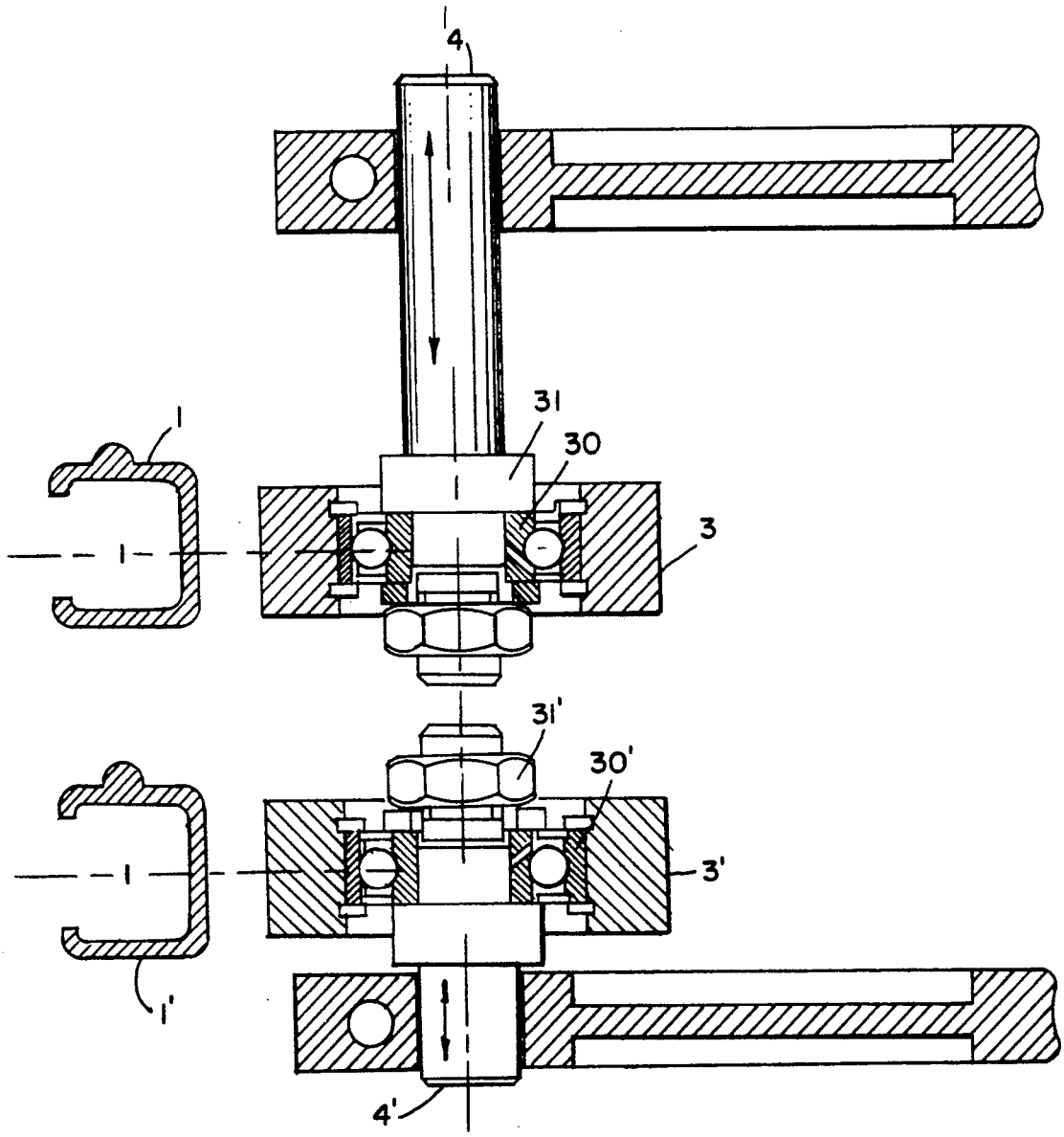
FIG. 2 is a cross-section of the control rollers of the mechanism represented in FIG. 1.

The rapier heads (1) and (1') as represented in FIG. 1 are each provided with a pawl (2) respectively (2'), which opens under the pressure of two rollers (3) and (3').

The rollers (3) and (3') are mounted on bearings (30) and (30') which are attached adjustable in height to shafts (4) and (4') by means of nuts and bolts, respectively (31) and (31').

The shafts (4) and (4') are themselves longitudinally adjustable on the respective control levers (5) and (5'). These control levers (5) and (5') are directly connected to the oscillating shaft (6) of an oscillating cam lever (7). This cam lever is provided with two cam rollers (8) and (9), which are symmetrically disposed in relation to a disk (10), which is provided with a double cam comprising a first and second lateral cam. This double cam runs in an oil bath in a closed housing (11), which is part of the support (12) of the control mechanism according to the invention. This support (12) is adjustable in weaving width on a crossbeam (13) of the weaving machine. For this purpose this crossbeam is provided with a groove (17), in which a projection (18) of support (12) can be slid and screwed down with the assistance of a nut and bolt (19).

The shaft (14) of the double cam disk (10) of the control mechanism of the rapier heads according to the invention is further coupled via a universal joint (15) to a drive shaft (16), which is slidable into another drive shaft (20) and screwed down onto it by means of a collar (21) provided with two pressure screws (22). The drive shaft (20) is usually driven from the main shaft 23 of the weaving machine according to known means.

By means of pawl (2) and (2'), the receiving rapiers of the rapier heads can open with a rather short control angle (e.g. 20°). The conversion from rotation movement to oscillating movement occurs with a very short kinematic chain. Thanks to the double cam a positive and clearance free drive is achieved. The whole of the control mechanism of the rapier heads as described is very compact and can be placed next to the temples. A speed of 450 r.p.m. can be achieved for a double rapier weaving machine.

I claim:

1. A control mechanism for operating positively controlled openings of rapier heads of weaving machines equipped with rapiers, comprising a first and a second lateral cam, first and second cam rollers driven by the cams respectively, the rollers being mounted on an oscillating lever, one end of each of a first and second control levers directly connected to an oscillating shaft of the oscillating lever, said oscillating lever moving to and fro by means of the cams and the rollers, the cams being connected to a drive shaft and thereby having a uniform rotation speed.

2. The control mechanism of claim 1 wherein an opposite end of each of the first and second control levers are connected to first and second shafts respectively, first and second control rollers being mounted on the first and second shafts respectively such that each of the control rollers corresponds to first and second pawls of the rapier heads and each roller adapted to press the respective pawl when the mechanism is in operation.

3. The control mechanism of claim 2, wherein the first and second control rollers are mounted on first and second bearings mounted on the first and second shafts, the control rollers including height adjustment means for being adjustable in height over a length of each of the first and second shafts respectively.

4. The control mechanism of claim 1 wherein each of the first and second shafts having the first and second rollers, includes means for being adjustable longitudinally along a length of the first and second control levers.

5. The control mechanism of claim 1 further comprising, the cam rollers being symmetrically disposed on either side of a disk having the first and second cams.

6. The control mechanism of claim 5 wherein the first and second cams of the disk run in an oil bath placed in a closed housing.

7. The control mechanism of claim 5 wherein the disk is continuously rotatable on a horizontal shaft, the horizontal shaft being connected to the drive shaft by means of a universal joint, the drive shaft being connected to a main shaft of the weaving machine, wherein rotation of the main shaft effects a rotation of the drive shaft and the horizontal shaft.

8. The control mechanism of claim 7 wherein the drive shaft comprises a first drive shaft being slidably and adjustably connected tc a second drive shaft, the second drive shaft being connected to the main shaft of the weaving machine.

9. The control mechanism of claim 8 further comprising a support means for supporting the cam, the levers, the disk and the shafts, the support means being adapted to be adjustably attached on a cross beam of the weaving machine for adjusting a weaving width when the mechanism is in operation.

10. Weaving machines equipped with rapiers comprising a control mechanism for opening rapier heads of the rapiers, said control mechanism comprising a first and a second lateral cam, first and second rollers driven by the cams respectively, the rollers being mounted on a oscillating lever, first and second control levers directly connected to an oscillating shaft of the oscillating lever, said oscillating lever moving to and fro by means of the cams and the rollers, the cams being connected to a main shaft and thereby having a uniform rotation speed.

* * * * *